United States Patent [19]

Buckner et al.

[11] Patent Number: 4,852,654

[45] Date of Patent: Aug. 1, 1989

[54] WIRELINE HYDRAULIC ISOLATION PACKER SYSTEM

[75] Inventors: Robert K. Buckner, Rowlett; Norman W. Read, Dallas; Donald E. Ritchie, Houston, all of Tex.

[73] Assignee: Dresser Industries, Inc., Dallas, Tex.

[21] Appl. No.: 195,418

[22] Filed: May 13, 1988

Related U.S. Application Data

[63] Continuation of Ser. No. 10,059, Feb. 2, 1987, abandoned.

[51] Int. Cl.[4] ..... E21B 33/124

[52] U.S. Cl. ..... 166/277; 166/127; 166/191; 166/387

[58] Field of Search ..... 166/277, 382, 387, 385, 166/378, 127, 191, 119, 146, 147; 137/15, 315

[56] References Cited

U.S. PATENT DOCUMENTS

| | | | |
|---|---|---|---|
| 2,160,804 | 5/1939 | Hall et al. | 166/191 |
| 2,638,987 | 5/1953 | Condra | 166/191 |
| 3,100,536 | 8/1963 | Tamplen | 166/191 |
| 3,342,269 | 9/1967 | Garret | 166/119 |
| 3,437,142 | 4/1969 | Conover | 166/277 |
| 3,443,638 | 5/1969 | Haynie | 166/191 |
| 3,559,671 | 2/1971 | Douglas | 137/155 |
| 4,452,463 | 6/1984 | Buckner | 166/196 |
| 4,718,496 | 1/1988 | Tompkins | 166/127 X |

FOREIGN PATENT DOCUMENTS

| | | | |
|---|---|---|---|
| 704567 | 3/1965 | Canada | 166/147 |

OTHER PUBLICATIONS

Camco Catalog entitled "Packers and Completion Accessories Catalog" p. 52.

Camco 1980–1981 General Equipment Catalog, p. 1397.

*Primary Examiner*—Bruce M. Kisliuk

[57] ABSTRACT

A unitary assembly (10); is disclosed for isolating a leak in a side pocket mandrel (12) between the tubing annulus (16) about a tubing string (14) and the interior (20) of the tubing string. The unitary assembly includes an upper packer (22), and a lower packer (24) interconnected by a tailpipe (26). The upper packer (22) is preferably set by a wireline tool and the lower packer is preferably set hydraulically. This eliminates the need for a drilling or workover rig to be setup over the well when patching a leak.

6 Claims, 3 Drawing Sheets

WIRELINE HYDRAULIC ISOLATION PACKER SYSTEM

This application is a continuation, of application Ser. No. 010,059, filed Feb. 2, 1987, now abandoned.

TECHNICAL FIELD

The invention relates to an improvement for sealing against leakage of fluids between a tubing string and tubing annulus at the location of a side pocket mandrel.

BACKGROUND OF THE INVENTION

When installing an oil production string, side pocket mandrels are frequently installed along the length of the string for enhanced recovery processes such as gaslift techniques. Each side pocket mandrel has a side pocket for receiving a gaslift valve. The gaslift valve is typically a one-way valve which allows higher pressure fluid in the annulus about the string to flow past the gaslift valve into the tubing string to assist in production.

Often, side pocket mandrels will be installed in the production string for future use, even though initially the well is self-producing. However, the production fluids often cause errosion of portions of the interior structure of the mandrel which causes leakage at the side mandrel between the tubing annulus and the tubing string. When such leakage occurs, it is necessary to plug the leak to maintain oil production.

Prior techniques for leak repair have frequently involved the use of separate upper and lower packers. Initially, a lower packer, often known as a "stove pipe packer", will be lowered into the tubing string to a position below the leak. The packer can then be set by wireline or a tubing string. If a tubing string is used, a drilling or workover rig must be positioned at the surface for operating the tubing string. Thereafter, a second, upper packer is run into the well, again on a wireline or by a tubing string to a position immediately above the leak. The upper packer will have a tailpipe extending downward from the upper packer which is stabbed into the lower packer to establish a sealed connection. The leak is thus isolated in the annular space between the interior of the side pocket mandrel and the exterior of the tailpipe between the upper and lower packers.

The present technique is quite expensive. If the packers are installed by tubing string, a drilling rig or workover rig must be set up over the well. If the packers are installed by wireline, it is very difficult to make the necessary sealed connection between the upper and lower packers to ensure an effective patch. A need therefore exists for a more economical and effective technique for patching such leakage in side pocket mandrels.

SUMMARY OF THE INVENTION

In accordance with one aspect of the present invention, an apparatus is provided for installing a tubing patch in a tubing string to seal against leakage of fluids between the tubing string and tubing annulus. The apparatus includes a unitary assembly having an upper packer to form a seal against the inner surface of the tubing string above the leak and a lower packer forming a seal against the interior of the tubing string below the leak. The upper and lower packers are connected by a tailpipe defining a passage through the assembly. The leak is thus isolated.

In accordance with another aspect of the present invention, the upper packer is preferably set by a wireline setting tool. The lower packer is preferably set by hydraulic fluid pressure within the tubing string.

In accordance with yet another aspect of the present invention, a method for installing a tubing patch in a tubing string to seal against leakage of fluid between the tubing string and tubing annulus is provided. The method includes the step of positioning an integral assembly having an upper packer and a lower packer connected by a tailpipe within the tubing string. The method further includes the steps of setting the upper and lower packers to seal against leakage. In accordance with another aspect of the present invention, the steps of setting the upper and lower packers further includes the step of setting the upper packer with a wireline setting tool, plugging the tubing string below the lower packer and pressurizing fluid within the tubing string to set the lower packer.

BRIEF DESCRIPTION OF THE DRAWINGS

With reference now to the following Detailed Description, taken in conjunction with the accompanying Drawings, wherein.

DETAILED DESCRIPTION

Figure 1:
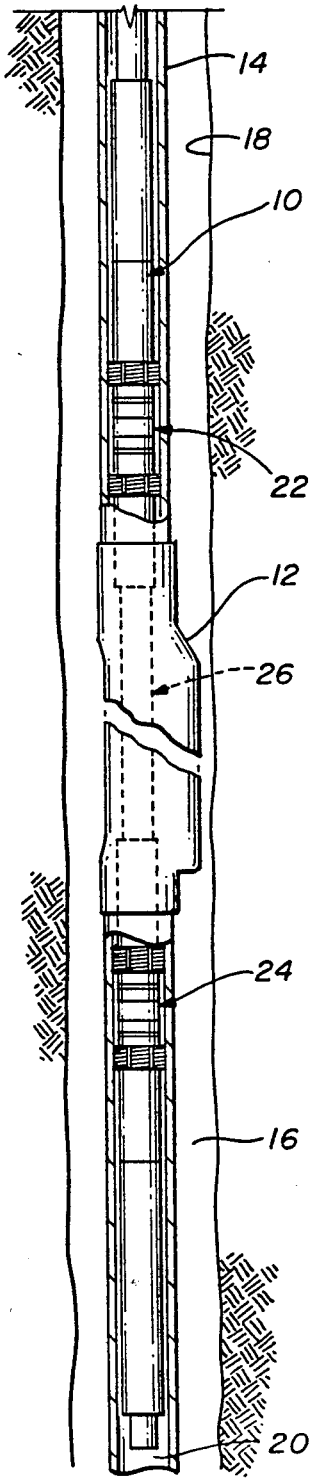
FIG. 1 illustrates a vertical cross-sectional view of a first embodiment of the present invention positioned within a tubing string.

With reference now to the figures, wherein like reference numerals designate like or corresponding parts throughout several views, an assembly 10 is illustrated which will patch a leak through the gaslift valve of a side pocket mandrel 12 in a tubing string 14. In the absence of assembly 10, leakage will occur between the tubing annulus 16 defined between the outer surface of the tubing 14 and the casing 18 and the interior 20 of the tubing string.

As will be discussed in greater detail, the assembly 10 has significant advantages over prior designs. The assembly 10 is an integral unit including an upper packer 22 and a lower packer 24 interconnected by a tailpipe 26. In contrast to prior designs, the assembly 10 is inserted as a unitary structure within the tubing string and lowered to a position straddling the leak through the side pocket mandrel 12. The upper and lower packers are activated to seal against the interior surface of the tubing string above and below the leak and the tailpipe defines a through passage 28 through the assembly for passage of production fluids. Thus, the leak is isolated by the assembly 10 and prevents leakage between the tubing annulus and interior of the tubing string.

Figure 2A:
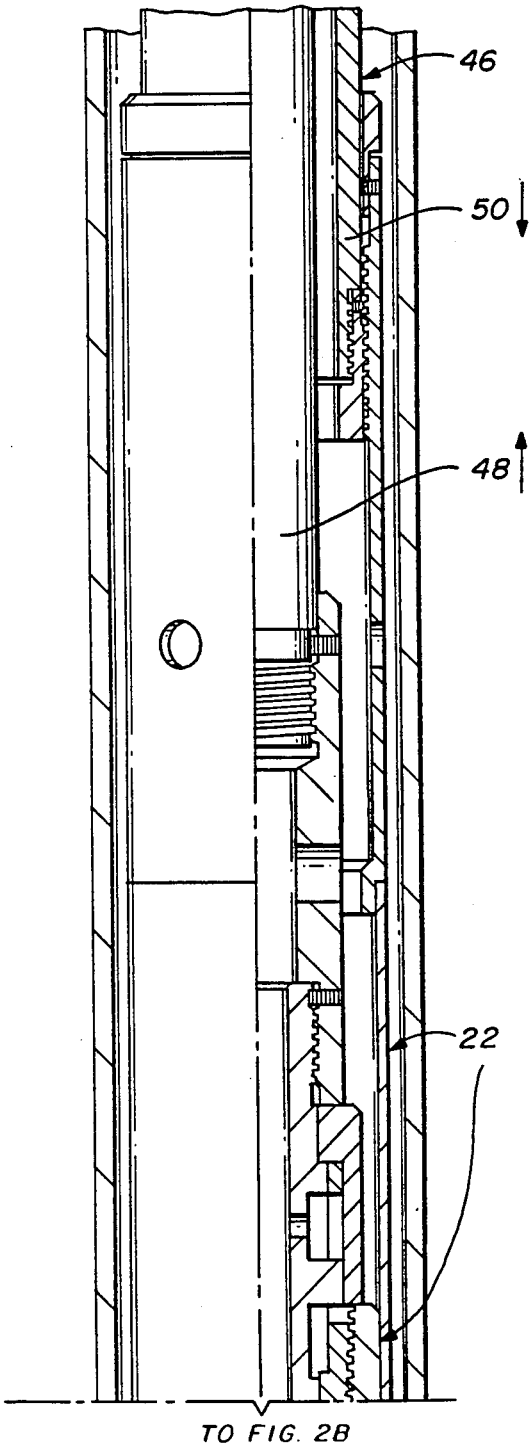
FIG. 2A is a vertical cross-sectional view of the wireline setting tool to set the upper packer.
Figure 2B:
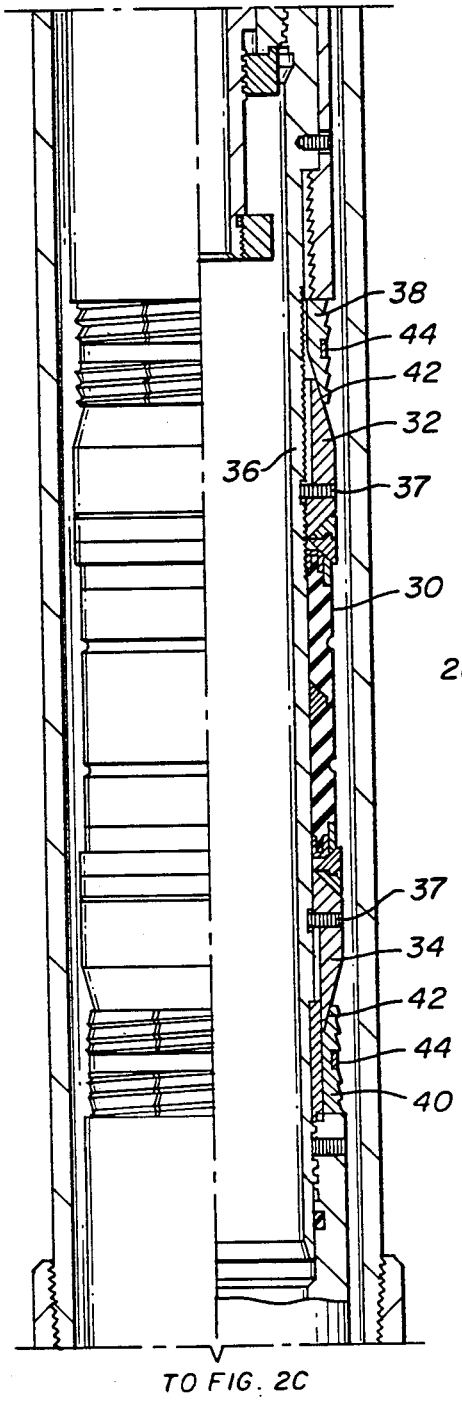
FIG. 2B is a vertical cross-sectional view of the upper packer.
Figure 2C:
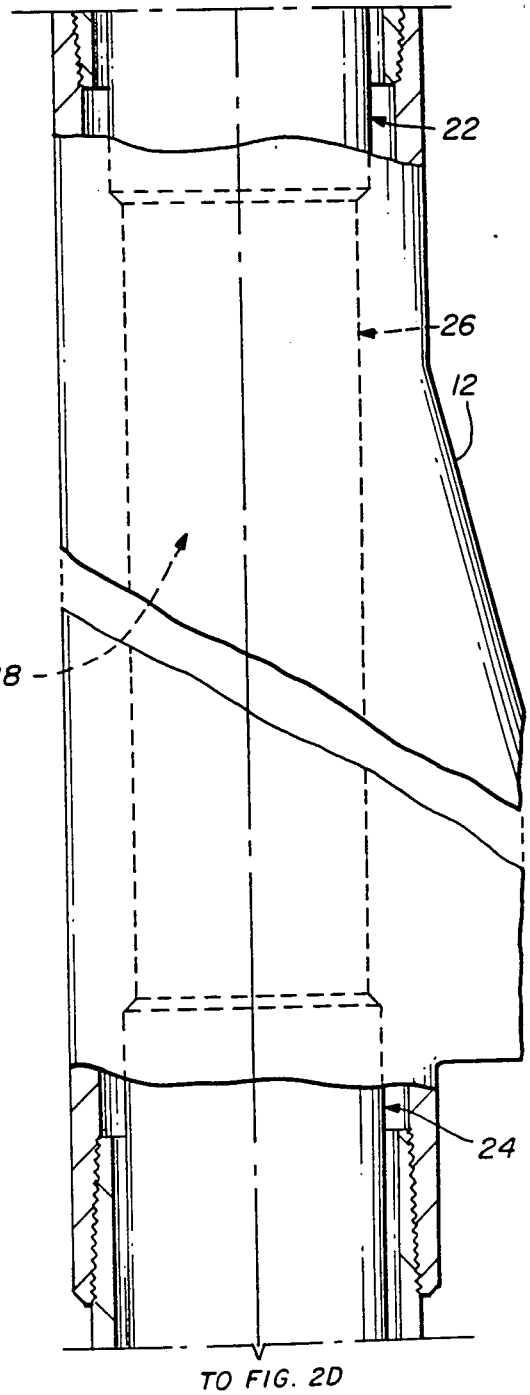
FIG. 2C is a vertical cross-sectional view of the tailpipe connecting the upper and lower packers.

With reference now specifically to FIGS. 2A and 2B, the upper packer 22 is a wireline set packer substantially identical in design and function to the packer disclosed in U.S. Pat. No. 4,452,463, issued June 5, 1984 to the assignee of the present invention, which disclosure is hereby incorporated by reference.

The upper packer 22 is provided with a sealing assembly 30 which is mounted between upper and lower expander heads 32 and 34. The expander heads, in turn, are frangibly connected to a tubular mandrel 36 by shear pins 37. Upper and lower sets of slips 38 and 40 are held in place on frustro conical surfaces 42 of the expander heads by frangible bands 44.

To set the upper packer, a wireline setting tool 46 is used, as seen in FIG. 2A which is an electric wireline set tool. The upper set of slips 38 are first urged radially outward to anchor against the interior of the tubing string by downward movement of cross link sleeve 50 of wireline setting tool 46. Setting mandrel 48 of setting tool 46 is then lifted upwardly, causing mandrel 36 to also lift upwardly and break the frangible connections of the expander heads 32 and 34 and shear pins 37. This squeezes the elastomeric sealing assembly 30 so that it expands radially outward and seals against the interior wall of the tubing string 14.

The tailpipe 26 extends downwardly from the now set upper packer 22 for a length sufficient to pass by the point of leakage in the side pocket mandrel.

The lower packer 24 is preferably a hydraulic set packer such as a drillable packer magnum series Type "GT" hydraulically activated packer manufactured by Dresser Industries, Inc. The packer operates in a manner similar to the upper packer 22, but its operation is initiated by hydraulic pressure within the interior 20 of the tubing string. Preferably, a landing nipple 52 is secured to the lower end of the lower packer 24. A plug 54 can be lowered through the tubing string to plug the landing nipple 52 when the lower packer 24 is to be set. Use of the plug 54 and landing nipple 52 only requires that the fluid in interior 20 down to the plug need be pressurized to activate the lower packer.

Figure 2D:
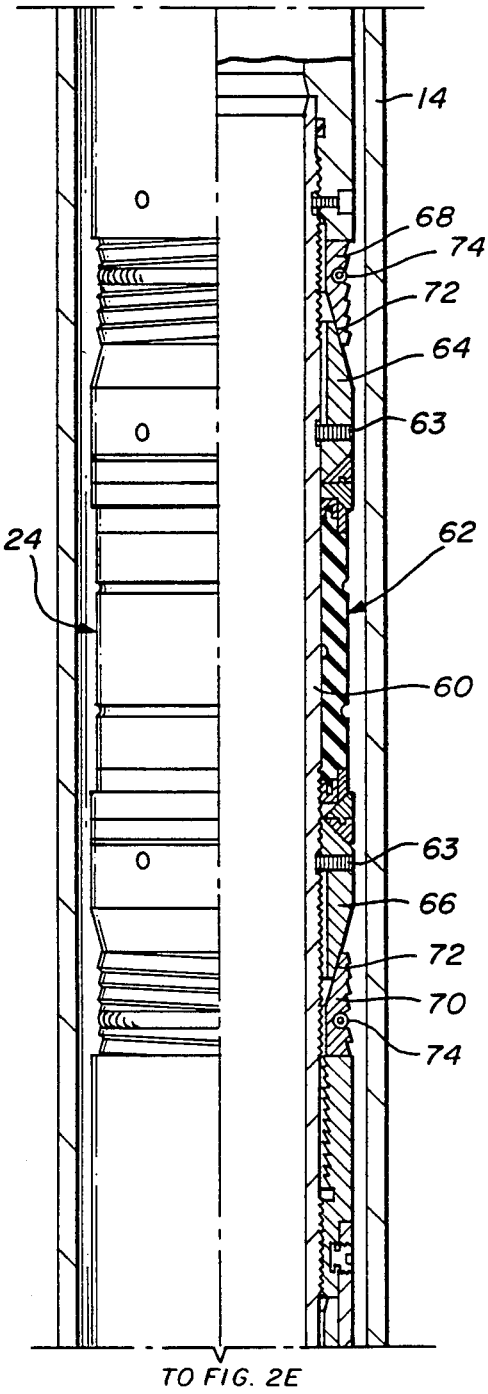
FIG. 2D is a vertical cross-sectional view of the hydraulically activated lower packer.
Figure 2E:
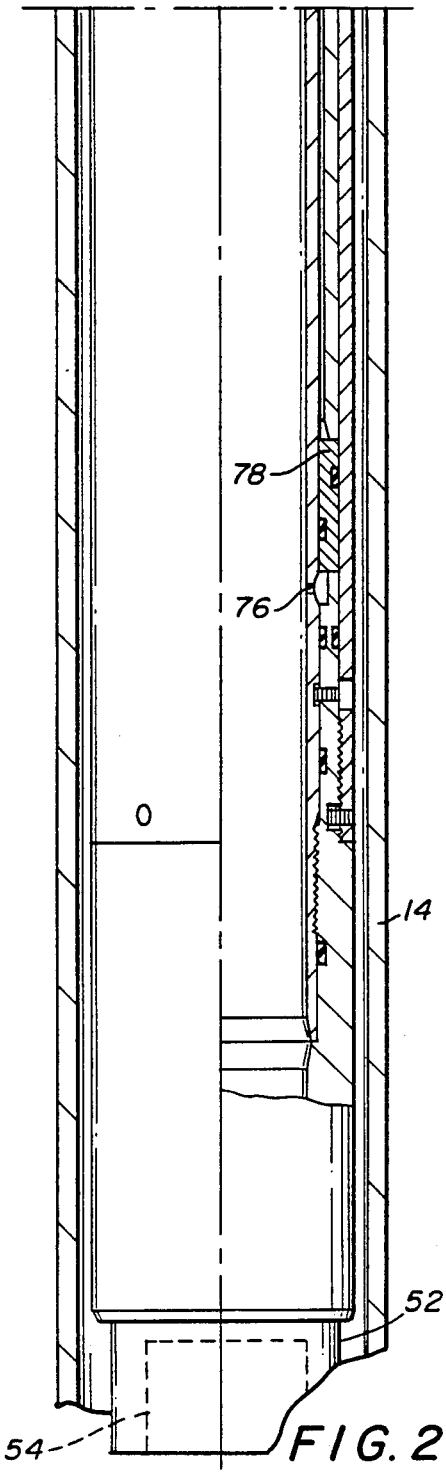
FIG. 2E is a vertical cross-sectional view of the landing nipple for plugging the tubing string to set the lower packer.

With reference to FIGS. 2D and 2E, details of the lower packer 24 can be seen. The lower packer 24 includes a tubular mandrel 60 divided with a sealing assembly 62. The sealing assembly 62 can be urged outward against the interior wall of the tubing string 14 to form a seal thereagainst, thus isolating the annular space between the exterior of the assembly 10 between the packers 22 and 24 and the interior of the tubing string where the leakage occurs. Upper and lower expander heads 64 and 66 are positioned on opposite sides of the sealing assembly 62 and are fixed by shear pins 63. An upper set of slips 68 cooperates with head 64 while a lower set of slips 70 cooperates with head 66. The cooperating heads and slips meet along frustro conical surfaces 72. Garter springs 74 hold the slips 68 and 70 in their retracted position until pressurized hydraulic fluid enters the interior of the tubing string and through pressure port 76 to act against an annular piston 78. The pressurized fluid pushes the piston 78 upward shearing pins 63 and, driving the heads, slips and sealing assembly together so that the sealing assembly 62 expands radially outward to seal against the interior of the tubing string. For one example, a setting pressure of 4,000 psi can be employed.

Thus, the present invention provides a very efficient apparatus and method for installing an isolation packer system to isolate a leak through, for example, a side pocket mandrel. However, it will be clear that the invention can be employed to isolate any leak along the tubing string. Furthermore, the invention does not require the use of either a drilling or workover rig.

While one embodiment of the present invention has been described in detail herein and shown in the accompany Drawings, it will be evident that various further modifications or substitutions of parts and elements are possible without departing from the scope and spirit of the invention.

We claim:

1. An apparatus for installing a tubing patch in a tubing string to seal against a leak of fluids between the interior of the tubing string and the tubing annulus, comprising:

an assembly insertable as a unit into the tubing string said unitary assembly defining a passage therethrough having an upper packer to form a seal against the interior of the tubing string above the leak and a lower packer to form a seal against the interior of the tubing string below the leak, a tailpipe connecting the upper and lower packers, and upper and lower packers being set sequentially, each packer being set without use of a drilling or workover rig to facilitate use in offshore environments.

2. The apparatus of claim 1 wherein the tubing string includes a side pocket mandrel, the leak of fluids between the interior of the tubing string and the tubing annulus being through the side pocket mandrel, the upper packer forming a seal against the tubing string above the side pocket mandrel and the lower packer forming a seal with the tubing string below the side pocket mandrel.

3. An apparatus for installing a tubing patch in a tubing string to seal against a leak of fluids between the interior of the tubing string and the tubing annulus, comprising:

a unitary assembly defining a passage therethrough having an upper packer to form a seal against the interior of the tubing string above the leak and a lower packer to form a seal against the interior of the tubing string below the leak, a tail pipe connecting the upper and lower packers, the upper and lower packers being set independently of each other, each packer being set without use of a drilling or workover rig to facilitate use in offshore environments, the upper packer set by a wireline tool and the lower packer being set hydraulically.

4. An apparatus for installing a tubing patch in a tubing string to seal against a leak of fluids between the interior of the tubing string and the tubing annulus, comprising:

a unitary assembly defining a passage therethrough having an upper packer to form a seal against the interior of the tubing string above the leak and a lower packer to form a seal against the interior of the tubing string below the leak, a tail pipe connecting the upper and lower packers, the upper and lower packers being set independently of each other, each packer being set without use of a drilling or work over rig to facilitate use in offshore environments, said apparatus further having a landing nipple attached to the lower packer for receiving a plug to isolate the interior of the tubing string above the plug to hydraulic operation of the lower packer.

5. An apparatus for installing a tubing patch in a tubing string to seal against a leak of fluids between the interior of the tubing string and the tubing annulus at a location of a side pocket mandrel, comprising:

a unitary assembly for insertion within the tubing string for positioning proximate the leak, the assembly including;

(a) an upper packer defining a passage therethrough and having means for forming a seal against the interior surface of the tubing string above the side pocket mandrel, the upper packer being set by wireline tool;

(b) a pipe secured to the upper packer and extending downwardly within the interior of the tubing string, said pipe defining a passage therethrough forming an extension of the passage through the upper packer; and (c) a lower packer attached to said pipe and defining a passage therethrough forming a continuation of the passage through the pipe, said lower packer forming a seal against the interior of the tubing string below the side pocket mandrel, the lower packer being set by hydraulic pressure within the interior of the tubing string, the lower packer being set subsequent to setting of the upper packer by the wireline tool, the leak in the side pocket mandrel thereby being isolated from the interior of the tubing string above and below the packers, the use of packers set by a wireline tool and hydraulic pressure eliminating the need for use of a drilling or a workover rig to install the tubing patch.

6. A method for installing a tubing patch in a tubing string to seal against leakage of fluid between the interior of the tubing string and the tubing annulus, comprising the steps of:

positioning an integral assembly having an upper packer set by a wireline tool and a lower packer set by hydraulic pressure within the interior of the tubing string within the tubing string proximate the leak;

setting the upper packer with the wireline tool to form a seal against the interior of the tubing string above the leak; and subsequently setting the lower packer with hydraulic pressure within the interior of the tubing string independently of the setting of the upper packer to form a seal against the interior of the tubing string below the leak to thus isolate the leak.

* * * * *